United States Patent [19]

Collins

[11] Patent Number: 4,842,481

[45] Date of Patent: Jun. 27, 1989

[54] FLUID PUMPS

[76] Inventor: Ross S. Collins, Echuca, Victoria, Australia

[21] Appl. No.: 133,521

[22] Filed: Dec. 16, 1987

[51] Int. Cl.[4] ..... F04D 3/00

[52] U.S. Cl. ..... 415/206; 415/211.2

[58] Field of Search ..... 415/183, 185, 191, 192, 415/203, 204, 206, 213 C, 219 R, 208, 209, 189, 190

[56] References Cited

U.S. PATENT DOCUMENTS

| | | | |
|---|---|---|---|
| 1,536,754 | 5/1925 | Benson | 415/209 X |
| 2,459,220 | 1/1949 | Espy | 415/213 C |
| 2,940,659 | 6/1960 | Stalker | 415/213 C |
| 2,955,746 | 10/1960 | Stalker | 415/191 |
| 3,447,740 | 6/1969 | Fabri et al. | 415/204 X |
| 4,182,595 | 1/1980 | Burney et al. | 415/204 |

FOREIGN PATENT DOCUMENTS

| | | | |
|---|---|---|---|
| 223071 | 7/1959 | Australia | 415/207 |
| 2060271 | 6/1972 | Fed. Rep. of Germany | 415/183 |
| 246462 | 6/1987 | German Democratic Rep. | 415/185 |
| 82/04284 | 12/1982 | PCT Int'l Appl. | 415/185 |
| 454072 | 9/1936 | United Kingdom | 415/207 |
| 827670 | 9/1958 | United Kingdom | 415/213 C |

*Primary Examiner*—Edward K. Look
*Assistant Examiner*—Joseph M. Pitko
*Attorney, Agent, or Firm*—Merchant, Gould, Smith, Edell, Welter & Schmidt

[57] ABSTRACT

A fluid pump has an impeller rotatably mounted within the pump chamber, an inlet flow guide directs incoming fluid to the impeller vanes and an outlet flow guide between the impeller and the outlet of the pump chamber completes the change of the direction of the fluid moved through the pump from substantially coaxial with the rotation of the impeller to substantially tangential to the impeller axis.

20 Claims, 1 Drawing Sheet

FLUID PUMPS

The invention relates to fluid pumps. The fluid pump of the invention is applicable for the pumping of water and it will be convenient to hereinafter disclose the invention in relation to that exemplary application. It is to be appreciated however, that the invention could be used for other fluids and applications.

In agricultural applications such as flood irrigation, water pumps are needed to help direct the water to the required areas. These irrigation pumps operate at low heads and are required to handle relatively high volumes of water.

One type of pump presently used in such applications is submersible axial pumps. These pumps need to be submerged in the water to be pumped. Because they are submerged, sealed bearings or water lubricated bearings are needed to support the shaft of the pump impeller. Sealed bearings however add significantly to the cost of the pump. If water lubricated bearings are used, it is necessary that the pump be always fully submerged. If there is a loss of water, damage to the bearings can result.

Another type of pump used is the so called "fire fighting" type pump which is distinguishable by the large tank attached to the pump. This tank would be normally filled with water, the tank water being used to "prime" the pump during starting up of the pump. The pump must be filled with water during start up to allow the suction head to be formed across the pump. The need to append a tank to the pump makes the relative size of the whole unit larger than for other pumps of similar capacity.

It is an object of the present invention to provide an improved pump.

It is preferable that the pump be relatively simple and inexpensive to produce. It is also preferable that the pump be self-priming.

With this in mind, the present invention provides a fluid pump comprising a pump casing having a chamber therein and an inlet and outlet to the chamber, an impeller rotatably mounted about its axis within the chamber, the impeller having a central hub with a plurality of vanes extending from the hub, rotation of the impeller causing transference of fluid admitted into the chamber via the inlet through the chamber and out the outlet, an inlet flow guide situated between the inlet and impeller to direct the fluid towards the impeller, and an outlet flow guide situated between the impeller and outlet to direct the fluid from the impeller in a direction substantially tangential relative to the axis of the impeller.

An embodiment of the invention is described in detail in the following passages of the specification which refer to the accompanying drawings. The drawings, however, are merely illustrative of how the invention might be put into effect, so that the specific form and arrangements of the various features as shown is not to be understood as limiting on the invention.

Figure 1:
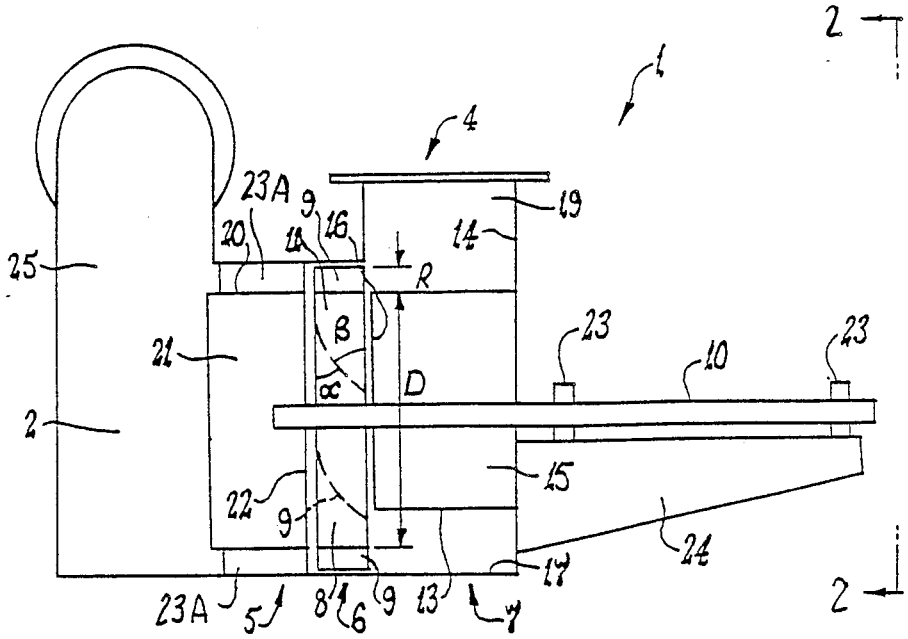
FIG. 1 is a schematic mainly cross-sectional view of a fluid pump according to the present invention.

The fluid pump shown in the drawings has a pump casing 1 with a pump chamber 2 having an inlet 3 and outlet 4.

Mounted within the pump chamber 2 is an inlet flow guide at 5, a pump impeller at 6 and an outlet flow guide at 7. Rotation of the impeller 6 causes transference of fluid admitted into the chamber 2, via the inlet flow guide 5, the impeller 6 and the outlet flow guide 7, and out the outlet 4.

The impeller 6 has a central hub 8 and a plurality of vanes 9 extending from the hub 8, the impeller 6 being mounted about its axis on a shaft 10. The hub 8 has a generally cylindrical wall surface 11 from which the vanes 9 extend radially outwards. Each vane 9 is preferably curved as shown and extends at a substantial angle across the cylindrical wall surface 11 relative to the axis of the impeller 6.

In a preferred configuration of the vanes as shown in FIG. 1, the approach angle $\alpha$ of each vane is about 15° whereas the departure angle $\beta$ of each vane is about 25°. These angles have been found to provide an optimum performance for the pump although it is to be appreciated that other angles may be preferred for different applications and that the present invention is not limited to the above angles.

Figure 2:
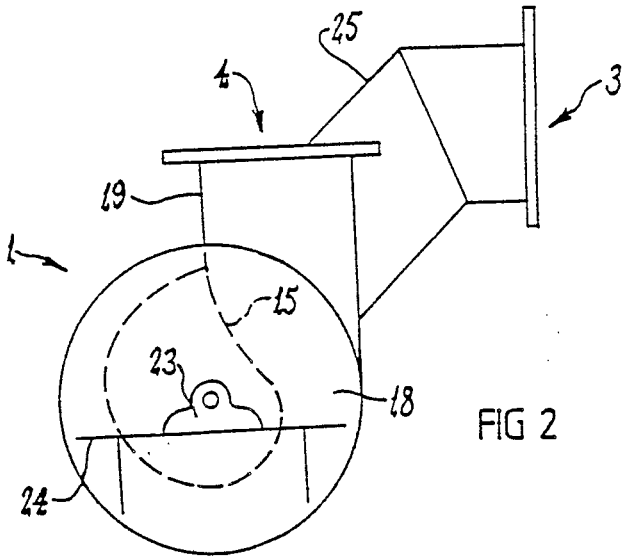
FIG. 2 is a schematic end view of the fluid pump of FIG. 1 as seen from view II—II.

The outlet flow guide 7 comprises stator 13 mounted to the chamber end wall 14. The stator 13 has a non-circular stator peripheral wall 15 and a stator end wall 16, the stator 13 being mounted adjacent the impeller 6 with the stator end wall 16 being in close proximity to the impeller 6 to limit fluid flow between the impeller 6 and the stator end wall 16. The stator peripheral wall 15, the chamber side wall 17 and chamber end wall 14 all define a volute space 18 as best seen in FIG. 2. The outlet 4 which may be connected to a discharge pipe 19, permits fluid to discharge from the volute space 18 defined by the stator 13 and chamber 2.

The inlet flow guide 5 comprises a central guide portion 20 having a cylindrical guide wall 21 and a guide end wall 22. The central guide portion 20 thus limits the fluid flow past the inlet flow guide 5 to an annular space around the central guide portion 20.

A plurality of guide blades 23 extend from the guide wall 21 of the central guide portion 20 supporting the central guide portion 20 within the chamber 2. Each of the guide blades 23A are preferably flat and substantially aligned with the axis of the impeller. With the guide blades 23 so aligned, the chamber side wall 17 surrounding the inlet flow guide 5 and the guide wall 21 define, with guide blades 23A, a series of axially extending passages for fluid flow. The guide blades act to reduce "swirl" of the water within the chamber 2 when the pump is in operation to reduce the turbulence and thereby reducing the friction losses and subsequent pressure drop across the pump.

The inlet flow guide 5 is also preferably mounted adjacent the impeller 6 with the guide end wall 22 being in close proximity to the impeller 6 to limit water flow between the impeller 6 and the guide end wall 22.

In the preferred arrangement, the axis of the central guide portion 20 is aligned with the axis of the impeller and the diameter of the central guide portion 20 is substantially equal to the diameter of the impeller hub 8. In this way, the fluid flow is guided in a substantially axial direction by the inlet flow guide 5 directly to the impeller vanes 9.

Preferably the diameter D of the impeller hub 8 is substantially greater than the radial dimension R of the impeller vane 9. As the tangential speed increases towards the periphery of the impeller 6, the fluid is therefore entrained by the fastest portion of the impeller 6 i.e. the impeller vanes 9. The advantage of this arrangement is that the rotational speed of the impeller 6 may be relatively lower than for "propeller" type impellers which have substantially longer vanes relative to the hub diameter, i.e. the tangential speed of the vane near the hub must be sufficiently high to allow sufficient entrainment of fluid thereby necessitating a high rotational speed for propellor type impellers to be effective. Because of the relatively lower rotational speed of the impeller, the fluid pump of this invention has a relatively lower power requirement compared with other pump impellers of similar size.

The impeller shaft 10 protrudes out of the chamber end wall 14 and is rotatably supported outside of the pump casing 1 by bearings 23. The bearings 23 are supported on a bracket 24 extending from the pump casing 1. As the bearings are mounted externally, expensive sealed bearings or water-lubricated bearings are not required thereby lowering the cost of production of the pump as well as allowing ready access to the bearings 23.

Nevertheless, it is advantageous to have a further support for the shaft 10 within the chamber 2 to prevent radial deflection of the shaft. This may occur when solid matter such as wood and stone pieces are entrained within the fluid flow and impact against the impeller vanes. A water lubricated bearing (not shown) may therefore also be provided to rotatably support the shaft 10 within the chamber 2. This water lubricated bearing may be supported within the inlet flow guide 5.

To enable the pump to be self-priming it is necessary that the pump chamber 2 be at least partially filled with fluid before start up of the pump. Normally, with non self-priming pumps, when fluid supply is lost from the inlet of the pump, the pump discharges the remaining fluid within the pump chamber leaving it substantially empty of fluid. The pump is therefore not able to restart pumping without the pump chamber being manually refilled with fluid.

In the pump of the present invention, the inlet flow guide 5, and the abrupt change in fluid flow direction from substantially axial to substantially tangential relative to the axis of the impeller, prevents the total loss of fluid from the pump chamber when the fluid supply is lost from the inlet. As the fluid supply is lost, air enters the pump chamber 2. The inlet flow guide 5 prevents the remaining fluid from swirling around within the chamber 2 which can cause further entrainment of air and loss of fluid.

Furthermore, as the air and remaining fluid enters the volute space 18 of the outlet flow guide 7, the abrupt change in direction causes the air to rise and be ejected from the outlet pipe 19 leaving the fluid within the chamber 2. A substantial amount of the fluid therefore remains within the chamber 2. To ensure that the loss of fluid is minimised the outlet 4 is preferably situated above the pump chamber 2 when the pump is in operation. Furthermore the inlet 3 of the pump is preferably also situated above the pump chamber 2 when the pump is in operation. An inlet pipe 25 extending from the pump casing 1 may be provided for this purpose. In this way the pump chamber normally remains at least partially filled with fluid and there is no need to prime the pump before every use.

For simplicity of construction, the pump casing 1 can be made from a substantially cylindrical section having blanked off ends. The inlet pipe 25 and outlet pipe 19 can then be simply attached to the cylindrical section. In addition, with the shaft 10 having extended bearings 23, the overall cost of production and subsequent maintenance of the pump is relatively lower than for other pumps of similar capacity.

Another advantage of the fluid pump over prior pumps is that the pump can be self-priming because of the nature of the fluid flow through the pump which allows the pump chamber to remain at least partially filled with fluid.

Various alterations, modifications and/or additions may be introduced into the construction and arangements of parts previously described without departing from the spirit or ambit of the invention as defined by the appended claims.

The claims defining the invention are as follows:

1. A liquid pump comprising a pump casing having a cylindrical body portion providing a chamber with a cylindrical wall and end walls therein and an inlet and an outlet to the chamber, an impeller rotatably mounted about its axis within the chamber, the impeller having a central hub with a plurality of vanes extending from the hub, rotation of the impeller causing transference of liquid admitted into the chamber via the inlet through the chamber and out the outlet, the outlet being at a higher level than the chamber when the pump is located with the axis of the impeller in a substantially horizontal in use position, an inlet flow guide situated between the inlet and impeller to direct the liquid towards the impeller in a direction substantially parallel to the impeller axis, and an outlet flow guide situated between the impeller and outlet comprising a non-circular stator having an outer peripheral wall, the stator mounted on and extending from one of the end walls of the chamber and located adjacent the impeller, the cylindrical wall of the chamber surrounding the stator, the one end wall and the outer peripheral wall of the stator defining a volute space to direct liquid flow to the outlet in a direction substantially tangential relative to the axis of the impeller.

2. A pump according to claim 1 wherein the central hub of the impeller has a cylindrical wall surface, the vanes extending substantially radially from the cylindrical wall surface.

3. A pump according to claim 2 wherein each vane is curved and extends at a substantial angle across the cylindrical wall surface of the hub relative to the axis of the impeller.

4. A pump according to claim 3 wherein the approach angle of each of the impeller vanes is 15° and the departure angle of each of the impeller vanes is 25°.

5. A pump according to claim 1 wherein the inlet flow guide comprises a central guide portion having a cylindrical guide wall and an end guide wall, and a plurality of guide blades extending from the cylindrical guide wall, the central guide portion being supported within the chamber by the guide blades, the guide blades being substantially flat and substantially aligned with the axis of the impeller, the walls of the chamber surrounding the inlet flow guide and the guide blades thus define a plurality of axially extending passages for liquid flow to the impeller.

6. A pump according to claim 5 wherein the hub of the impeller has a diameter at least substantially identical to the diameter of the central guide portion of the inlet flow guide, the axis of the impeller being aligned with the axis of the central guide portion so that fluid flowing through the axially extending passages are directed to the impreller vanes.

7. A pump according to claim 6 wherein the diameter of the impeller hub is substantially greater than the radial dimension of the impeller vanes.

8. A pump according to claim 1 wherein the impeller is rotatably mounted on a shaft, a portion which is rotatably supported outside the pump casing.

9. A pump according to claim 8 wherein the shaft is further rotatably supported within the pump chamber.

10. A pump according to claim 1 wherein the inlet of the pump is at a higher level than the chamber when the pump is located with the axis of the impeller in a substantially horizontal in use position.

11. A pump according to claim 1 wherein the inlet and outlet of the chamber are connected to pipe sections extending from the cylindrical body section of the pipe casing.

12. A liquid pump comprising a pump casing having a cylindrical body portion providing a chamber with a cylindrical wall and end walls therein and an inlet and outlet to the chamber, an impeller within the chamber rotatably mounted about its axis on a shaft, a portion of the shaft being rotatably supported outside the casing, the impeller having a central hub with a plurality of vanes extending from the hub, rotation of the impeller causing transference of liquid admitted into the chamber via the inlet through the chamber and out the outlet, the outlet being at a higher level than the chamber when the pump is located with the axis of the impeller in substantially horizontal in use position, an inlet flow guide situated between the inlet and impeller comprising a central guide portion having a cylindrical guide wall and an end guide wall, and plurality of guide blades extending from the cylindrical guide wall, the central guide portion being supported within the chamber by the guide blades, the guide blades being substantially flat and substantially aligned with the axis of the impeller, the walls of the chamber surrounding the inlet flow guide and the guide blades thus define a plurality of axially extending passages to direct the liquid towards the impeller in a direction substantially parallel to the impeller axis, and an outlet flow guide situated between the impeller and the outlet comprising a non-circular stator having an outer peripheral wall, the stator mounted on and extending from one of the end walls of the chamber and located adjacent the impeller, the cylindrical wall of the chamber surrounding the stator, the one end wall and the outer peripheral wall of the stator defining a volute space to direct liquid flow to the outlet in a direction substantially tangential relative to the axis of the impeller.

13. A pump according to claim 12 wherein the central hub of the impeller has a cylindrical wall surface, the vanes extending substantially radially from the cylindrical wall surface.

14. A pump according to claim 13 wherein each vane is curved and extends at a substantial angle across the cylindrical wall surface of the hub relative to the axis of the impeller.

15. A pump according to claim 14 wherein the approach angle of each of the impeller vanes is 15° and the departure angle of each of the impeller vanes is 25°.

16. A pump according to claim 12 wherein the hub of the impeller has a diameter at least substantially identical to the diameter of the central guide portion of the inlet flow guide, the axis of the impeller being aligned with the axis of the central guide portion so that fluid flowing through the axially extending passages are directed to the impeller vanes.

17. A pump according to claim 16 wherein the diameter of the impeller hub is substantially greater than the radial dimension of the impeller vanes.

18. A pump according to claim 12 wherein the shaft is further rotatably supported within the pump chamber.

19. A pump according to claims 12 wherein the inlet of the pump is at a higher level than the chamber when the pump is located with the axis of the impeller in a substantially horizontal in use position.

20. A pump according to claim 12 wherein the inlet and outlet of the chamber are connected to pipe sections extending from the cylindrical body section of the pump casing.

* * * * *